United States Patent [19]

Gordon et al.

[11] Patent Number: 4,747,583

[45] Date of Patent: May 31, 1988

[54] APPARATUS FOR MELTING METAL PARTICLES

[76] Inventors: Eliott B. Gordon, 2713 Hampshire #7, Cleveland Heights, Ohio 44106; David V. Neff, 3141 E. Derbyshire Rd., Cleveland Heights, Ohio 44118; Paul V. Cooper, 2240 Belvoir Blvd., Cleveland, Ohio 44121; Ronald E. Gilbert, 10999 Bridle Trail, Chardon, Ohio 44024

[21] Appl. No.: 61,025

[22] Filed: Jun. 10, 1987

Related U.S. Application Data

[63] Continuation of Ser. No. 781,538, Sep. 26, 1985, abandoned.

[51] Int. Cl.[4] ..... F27B 14/10

[52] U.S. Cl. ..... 266/235; 266/236; 266/901

[58] Field of Search ..... 266/235, 236, 901, 215, 266/242

[56] References Cited

U.S. PATENT DOCUMENTS 1,526,851 2/1925 Hall ..... 266/235

3,272,619 9/1966 Sweeney ..... 75/68 R 4,598,899 7/1986 Cooper ..... 266/235

*Primary Examiner*—Melvyn J. Andrews

*Attorney, Agent, or Firm*—Wayne D. Porter, Jr.; R. Lawrence Sahr

[57] ABSTRACT

A method of melting metal particles includes the steps of swirling molten metal in a vortex within a crucible, adding metal particles onto the surface of the metal, and submerging the metal particles substantially immediately after the particles have been added onto the surface. Apparatus for carrying out the method includes a mixer having a vertically oriented sleeve secured to the bottom of the crucible, the sleeve supporting a plurality of blades on its outer surface and having a plurality of openings adjacent its bottom. The blades force the metal particles beneath the surface of the metal and create turbulence which ensures rapid melting of the particles. The blades as well as the openings adjacent the bottom of the sleeve break up any agglomerated metal particles. Discharge piping is connected to the bottom of the crucible. A vortex breaker is disposed in the piping to control the vortex in the crucible.

13 Claims, 3 Drawing Sheets

APPARATUS FOR MELTING METAL PARTICLES

This application is a continuation of application Ser. No. 06/781538 filed Sept. 26, 1985, now abandoned.

BACKGROUND OF THE INVENTION

1. Field of the Invention

The invention relates to melting metal particles and, more particularly, to a method and apparatus for rapidly melting scrap metal particles of light metals such as aluminum within a crucible.

2. Description of the Prior Art

Light gauge, low density scrap metal particles such as chips, borings, and turnings are produced as a by-product of many metal processing operations. A significant amount of scrap metal also exists in the form of metal cans, particularly aluminum cans. For convenience, all such scrap metal will be referred to herein as "scrap metal" and "particles." In order to recover the scrap metal for productive use, it is necessary to remelt it. Unfortunately, a number of problems are presented when scrap metal is attempted to be remelted. These problems are particularly acute in the case of light metals such as aluminum due to the tendency of the metal to oxidize when melted. The problems are worse for small particles of scrap metal than large ones, because (1) small particles have a relatively large surface-to-volume ratio and (2) small particles tend to remain on the surface of a melting bath where they are oxidized while large particles sink rapidly beneath the surface without oxidizing.

Reverberatory furnaces have been used to melt scrap metal, but mechanical puddlers are necessary to achieve respectable recovery rates when small particles of scrap metal are being melted. Puddlers are expensive, bulky, mechanically complex, and are a source of iron contamination. Even with mechanical puddlers, melting of the scrap metal occurs slowly so that the metal tends to oxidize before it melts, resulting in recovery rates that are less than desirable. "Recovery rate" as used herein can be defined as follows:

$$\frac{(\text{Scrap Input Weight} \times \text{Moisture Factor}) - \text{Good Ingot Weight}}{(\text{Scrap Input Weight} \times \text{Moisture Factor})} \times 100$$

The situation is improved when induction furnaces are used. Strong inductive currents are set up in the molten metal which create a stirring action that rapidly submerges the scrap metal before additional oxide can form on the surface. Furthermore, the absence of high temperature combustion produces little or no oxide formation. The result is that recovery rates on the order of 97 percent can be attained. The chief drawback of the induction furnace melting technique is the high initial cost of the furnace. The cost can be so great as to make the scrap recovery process uneconomical despite the high recovery rates available. A further drawback of the induction furnace melting technique is that it is a batch process, rather than a continuous process.

A different approach to the problem of recovering scrap metal is disclosed in U.S. Pat. No. 3,272,619 (hereafter the '619 patent), to V. D. Sweeney et al, the disclosure of which is incorporated herein by reference. In the '619 patent, molten metal is circulated from a reverberatory furnace, through an external crucible where a vortex is established, and back into the furnace. Melting of scrap metal does not occur in the furnace. Rather, the scrap metal is introduced into the vortex established in the external crucible. As the scrap metal swirls down in the vortex, the scrap metal particles eventually are melted. By appropriate control of such parameters as the temperature of the molten metal being circulated, the moisture content of the particles, and the rate at which the particles are fed into the crucible, recovery rates of about 90 percent can be attained.

Although the system described in the '619 patent has been reasonably effective, certain problems have not been addressed. The '619 patent states that the intensity of the vortex can be adjusted to produce desired submerging rates, but such adjustment has proven difficult to achieve in practice. The high surface tension of the molten metal in the crucible permits solid particles to remain on the surface of the vortex completely down into the return pipe to the furnace. The result is that solids and air can reach the furnace, with a consequent lowering of melting efficiency. In effect, the scrap metal being melted is exposed excessively to air such that undesired quantities of dross are formed. It is possible that oxide-covered metal drops (referred to hereafter as "agglomerations") can pass completely through the crucible and back into the furnace. An additional concern related to the device according to the '619 patent is the sensitivity of the crucible to flow variations. Because the crucible is most efficient with metal flowing near the top, a slight increase in flow rate can cause a spillover. Additionally, such a high operating level in the crucible can cause loss of heat through the crucible itself.

SUMMARY OF THE INVENTION

In response to the foregoing considerations, the present invention provides a new and improved method and apparatus for melting metal particles wherein metal particles are mixed with molten metal flowing in a vortex in a crucible, and are submerged substantially immediately after being introduced into the flow of molten metal. The particles are submerged by a mixing means disposed within the crucible. In the preferred embodiment, the mixing means includes a vertically oriented sleeve disposed within the crucible and resting on the bottom of the crucible. The sleeve divides the crucible into a first chamber within the sleeve, and a second chamber surrounding the sleeve intermediate the outer wall of the sleeve and the inner wall of the crucible. The crucible includes an opening at its bottom through which molten metal may flow outwardly of the crucible. The sleeve is arranged such that the first chamber surrounds the opening in the crucible.

At least one blade is disposed within the second chamber and is attached to the outer surface of the sleeve. The blade substantially fills the gap between the outer wall of the sleeve and the inner wall of the crucible. In the preferred embodiment, three blades are provided, each disposed 120 degrees from adjacent blades. Each of the blades includes a leading edge disposed above the flow of metal and a trailing edge disposed beneath the surface of the molten metal. The blades are inclined at an angle of approximately 23 degrees relative to the horizontal. At least one opening is formed in the side wall of the sleeve adjacent the bottom of the crucible, the opening providing fluid communication between the first and second chambers. In the preferred embodiment, six such openings are provided, each spaced 60 degrees from adjacent openings.

Discharge piping is connected to the crucible for receiving molten metal from the crucible and conveying it away from the crucible. The discharge piping includes a vortex breaker for controlling, stabilizing, and stopping the vortex action so that virtually all mixing of scrap metal takes place in the crucible. In the preferred embodiment, the vortex breaker is a cylindrical body having a plurality of longitudinally extending passages. The discharge piping also includes a vertically oriented upper pipe insert which reduces the cross-section of the flow upstream of the vortex breaker, a downspout elbow downstream of the vortex breaker, and a lower discharge pipe which further reduces the cross-section of the flow.

In operation, molten metal is introduced into the second chamber such that a vortex is created. Particles of scrap metal are dropped onto the surface of the molten metal. Substantially immediately after being dropped onto the surface, the particles encounter one of the blades. The particles are submerged by their contact with the blades, whereupon the particles are melted very quickly. The turbulence created by the trailing edges of the blades contributes to the rapid melting of the particles. In the event an agglomeration occurs, the contact with the blades, coupled with the turbulence associated with the blades, tends to break up the agglomerations. Additionally, as the molten metal flows from the second chamber into the first chamber for discharge from the crucible, any remaining agglomerations of particles will be broken apart upon contacting the sleeve in the vicinity of the openings. The discharge piping controls, stabilizes, and eventually stops the vortex action so that virtually all mixing of scrap metal takes place in the crucible. The vortex breaker permits additional mixing turbulence for melting scrap metal and agglomerations that may have passed the mixer. The vortex breaker also permits a wide range of flow rate to exist without permitting air ingestion that would otherwise occur.

By use of the method and apparatus according to the invention, problems associated with the high surface tension of the molten metal in the crucible are overcome. The invention enables very high recovery rates to be attained, while holding capital costs to a minimum. The foregoing and other features and advantages of the present invention will become more apparent by reference to the following description and the accompanying drawings.

DESCRIPTION OF THE PREFERRED EMBODIMENT

Figure 1:
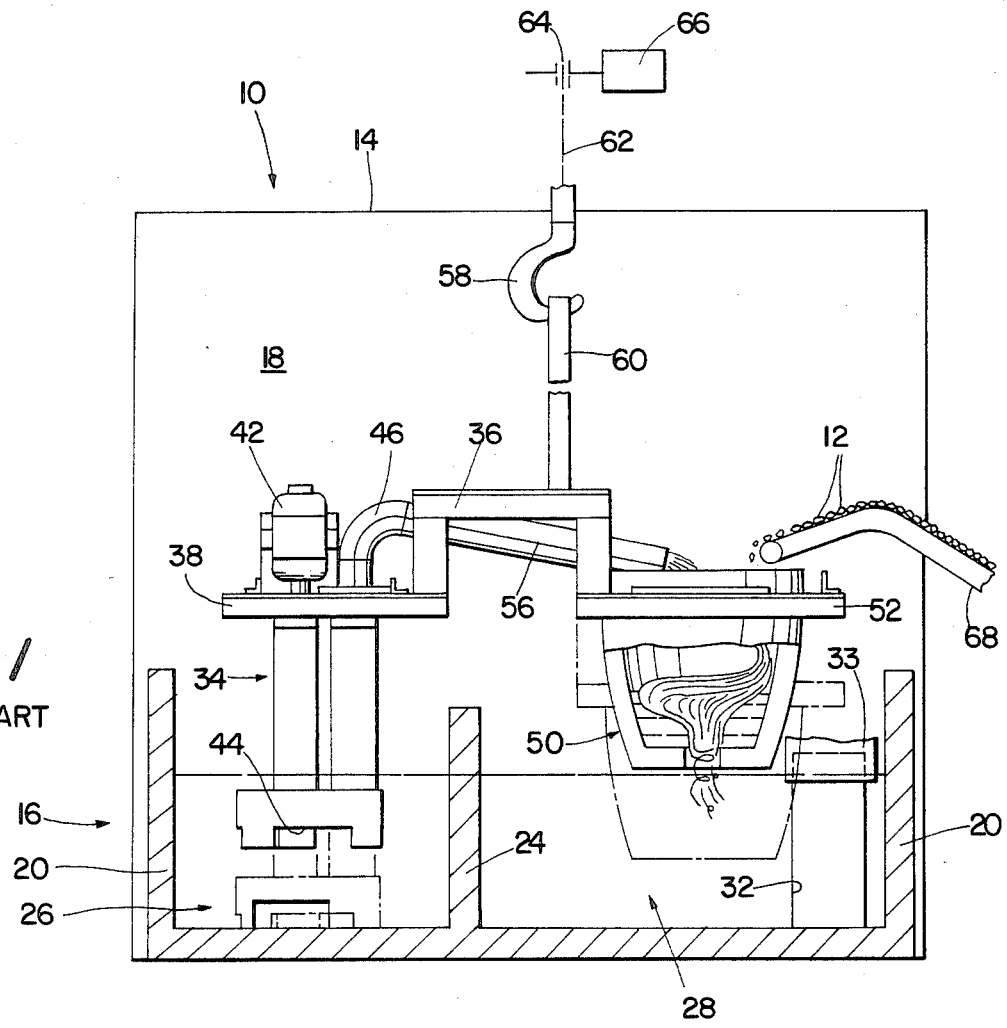
Fig. 1 PRIOR ART
FIG. 1 is a side elevational view, partly in section, of a furnace, molten metal pump, and crucible according to the prior art.
Figure 2:
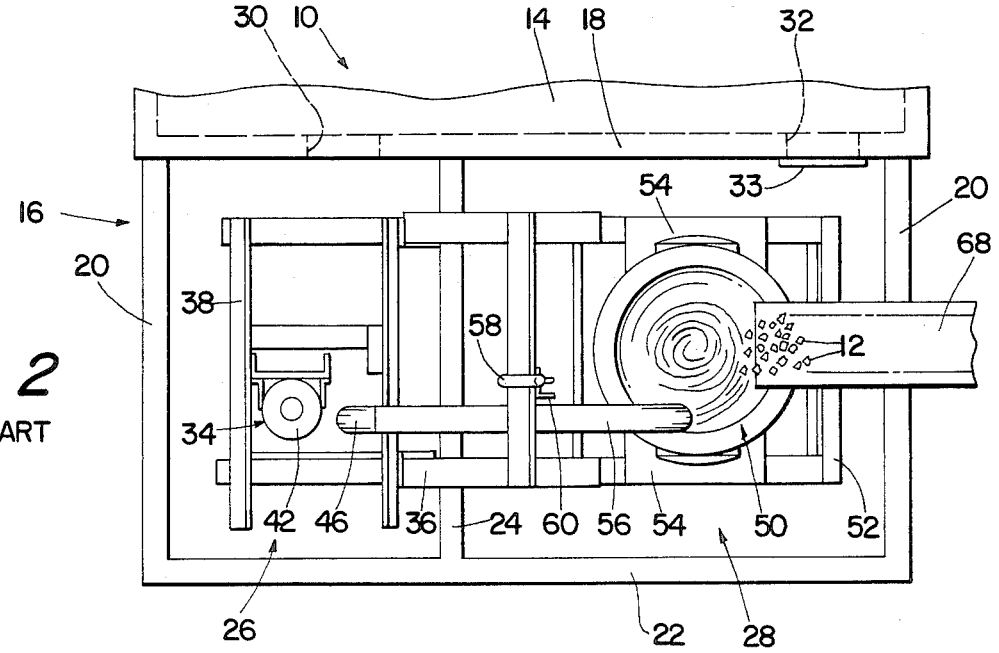
Fig. 2 PRIOR ART
FIG. 2 is a top plan view of the apparatus of FIG. 1.
Figure 3:
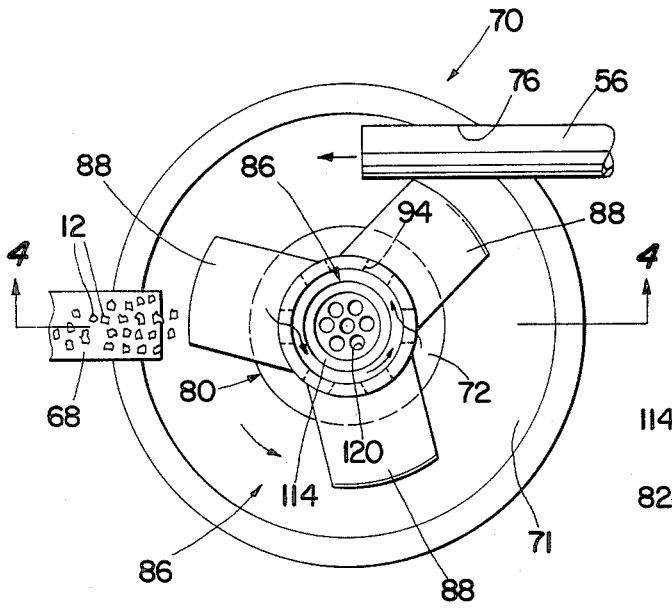
FIG. 3 is a top plan view of a crucible according to the invention showing a mixer disposed within the crucible and a portion of discharge piping at the bottom of the crucible.

Referring to FIGS. 1 and 2, apparatus 10 for melting light gauge, low density scrap metal particles 12 such as chips, borings, turnings, and the like is shown. Although the apparatus 10 is especially effective for melting particles 12 of aluminum, it is to be understood that the apparatus 10 can be used with other metals, if desired. The apparatus 10 is disclosed in detail in the '619 patent.

The apparatus 10 includes a furnace 14, preferably of the reverberatory type. The furnace 14 includes an auxiliary, open-topped hearth 16 disposed along a front wall 18. The hearth 16 includes side walls 20, a front wall 22, and a divider wall 24 parallel to the side walls 20. The wall 24 divides the hearth 16 into a first chamber 26 and a second chamber 28. An opening 30 is formed in the front wall 18 such that fluid communication is permitted between the furnace 14 and the first chamber 26. Similarly, a second opening 32 is formed in the wall 18 to provide fluid communication between the second chamber 28 and the furnace 14. The opening 32 is partially closed by a movable door 33.

A molten metal pump 34 is disposed in the first chamber 26. The pump 34 can be of the type disclosed in U.S. Pat. No. 3,048,384 to V. D. Sweeney et al. A supporting frame 36 includes an end portion 38 to which the pump 34 is mounted. The pump 34 includes an upright body 40 containing a vertical shaft, impeller, chambers, and pump passages. The pump 34 includes an actuating motor 42, a bottom inlet 44 through which metal is drawn from the first chamber 26, and an outlet 46 above the level of the divider wall 24 through which molten metal is discharged.

A crucible 50 is disposed atop the second chamber 28. The crucible 50 is connected to the supporting frame 36 by an end portion 52 having opposed gripping plates 54. A conduit 56 is connected to the pump outlet 46 and is positioned so as to direct a stream of molten metal into the crucible 50.

A hook 58 is connected to the support frame 36 by means of a suspending bar 60. The hook 58 is attached at the end of a vertically movable linkage 62 in the form of a chain or other flexible, elongate member. The linkage 62 is wrapped about a sprocket 64 driven by a reversing motor 66. As will be apparent from an examination of FIG. 1, upon rotation of the motor 66, the support frame 36 and the components connected to it will be raised or lowered relative to the first and second chambers 26, 28. A conveyer 68 is disposed above the crucible 50 such that particles 12 of scrap metal can be dropped into the crucible 50. Additional details concerning the components of the furnace 14 and their operation can be found in the '619 patent referred to previously.

Referring now to FIGS. 3–7, a crucible 70 according to the invention is shown. The crucible 70 is intended to be used in the apparatus 10 as a replacement for the crucible 50. The crucible 70 is manufactured from a high temperature, refractory material such as graphite and/or silicon carbide. Alternatively, the crucible 70 may be a castable refractory material housed within a steel shell. The crucible 70 includes a rounded side wall 71, a flat bottom wall 72, and an opening 74 in the bottom wall 72 through which molten metal can be discharged from the crucible 70. A rounded cut-out 76 is formed in the rim of the side wall 71 in order to provide a support for the conduit 56. The opening 74 is chamfered at an angle of about 15 degrees. In the embodiment illustrated, the outer diameter of the crucible at its upper end is approximately 28 inches, the side wall 71 is approximately 24½ inches high, and the opening 74 is 11 inches in diameter.

A mixer 80 is disposed within the crucible 70. The mixer 80 includes a cylindrical, generally vertically oriented sleeve 82. The sleeve 82 divides the crucible 70 into a first chamber 84 within the sleeve 82 and a second chamber 86 surrounding the sleeve 82 intermediate the outer wall of the sleeve and the side wall 71. A plurality of blades 88 are affixed to the outer wall of the sleeve 82 within the second chamber 86. The blades 88 extend from the sleeve 82 toward the side wall 71 so as to fill the gap between the outer wall of the sleeve 82 and the side wall 71. The blades 88 are cemented to the side wall 71 at their ends. Each of the blades is inclined relative to the horizontal at approximately a 23 degree angle, and includes a leading edge 90 and a trailing edge 92. The blades 88 are spaced equidistantly about the sleeve 82 which, in the embodiment illustrated, is a spacing of 120 degrees between adjacent blades. A plurality of rectangular openings 94 are formed in the sleeve 82 at its bottom. The openings 94 are spaced equidistantly about the circumference of the sleeve 82 which, in the embodiment illustrated, is a spacing of 60 degrees between adjacent openings. The height of the openings 94 is beneath the level of the trailing edges 92 of the blades 88.

In the embodiment illustrated, the sleeve 82 is made of a high temperature refractory material such as graphite, as are the blades 88. The sleeve 82 and the blades 88 are approximately one inch thick. The outer diameter of the sleeve 82 is approximately 11 inches, and the sleeve 82 is approximately 14 inches high. The openings 94 are 2½ inches high and 2¼ inches wide. The trailing edges 92 are about four inches from the bottom of the sleeve 82. The blades 88 have a chord of about 9½ inches at the point of their attachment to the sleeve 82. The sleeve 82 is positioned within the crucible 70 such that the first chamber 84 completely surrounds the opening 74.

Discharge piping 100 is connected to the crucible 70 for receiving molten metal from the crucible 70 and conveying it away from the crucible 70. The discharge piping 100 includes an upper pipe insert 102, a honeycomb vortex breaker 104, a downspout elbow 106, and a lower discharge pipe 108.

The upper pipe insert 102 has an outwardly flared upper end 110. The flared upper end 110 and the opening 74 have matching, frusto-conical tapers of about 15 degrees. Such a construction permits a solid, fluid-tight seal at the interface between the opening 74 and the insert 102. The insert 102 also includes a cylindrical inlet portion 112. A tapered shoulder 114 connects the inlet 112 with a cylindrical exit portion 116. In the embodiment illustrated, the inlet 112 has an inner diameter of 8 inches, the exit 116 has an inner diameter of 5½ inches, and the shoulder 114 tapers at an angle of 30 degrees relative to the longitudinal axis of the insert 102. The end of the exit 116 includes a 6 inch counterbore 118.

The vortex breaker 104 is in the form of a cylindrical body adapted to be fitted within the counterbore 118. A plurality of longitudinally extending passages 120 extend completely through the vortex breaker 104. The other end of the vortex breaker 104 is fitted within a counterbore 122 formed in the elbow 106. The elbow 106 includes a second counterbore 124 adapted to receive one end of the lower discharge pipe 108. The discharge pipe 108 includes a cylindrical inlet 126, a tapered shoulder 128, and a reduced-diameter, cylindrical exit 130. In the embodiment illustrated, the inlet 126 has a diameter of 5 inches, the shoulder 128 tapers at an angle of 45 degrees relative to the longitudinal axis of the discharge pipe 108, and the exit 130 has an inner diameter of 2¾ inches. If desired, offset elbows can be used in place of the elbow 106. Additionally, a P-trap (not shown) can be connected downstream of the elbow 106.

In operation, metal is melted in the furnace 14 and a level of molten metal is established in the furnace 14 and the first and second chambers 26, 28. The motor 66 is activated to position the inlet 44 beneath the surface of the molten metal in the first chamber 26. The pump 34 is activated to establish a flow of molten metal through the conduit 56 into the crucible 70. As can be seen from an examination of FIGS. 3 and 7, a counterclockwise flow of molten metal is established in the crucible 70, thus creating a vortex. The motor 66 is operated such that the bottom wall 72 is always above the level of liquid in the second chamber 28. Further, the pump 34 is operated in such a manner as to establish a flow of molten metal sufficient to create a liquid level in the crucible within the range of about 6–12 inches above the bottom wall 72. Under these operating conditions, the leading edges 90 are disposed above the level of molten metal at all times, and the trailing edges 92 are disposed beneath the level of molten metal at all times.

After a vortex has been established in the crucible 70, scrap metal particles 12 are conveyed into the second chamber 86. Substantially immediately after being deposited onto the surface of the molten metal, the particles are submerged by virtue of their contact with the underside of one or more of the blades 88. Not only are the particles submerged by their contact with the underside of the blades 88, but the turbulence created by the trailing edges 92 contributes to a rapid melting of the particles 12.

Figure 7:
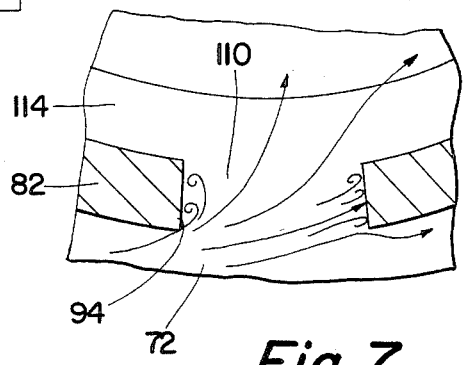
FIG. 7 is an enlarged cross-sectional view of the mixer of FIG. 6 taken along a plane indicated by line 7—7 in FIG. 6 showing fluid flow paths in the region of an outlet.
Figure 6:
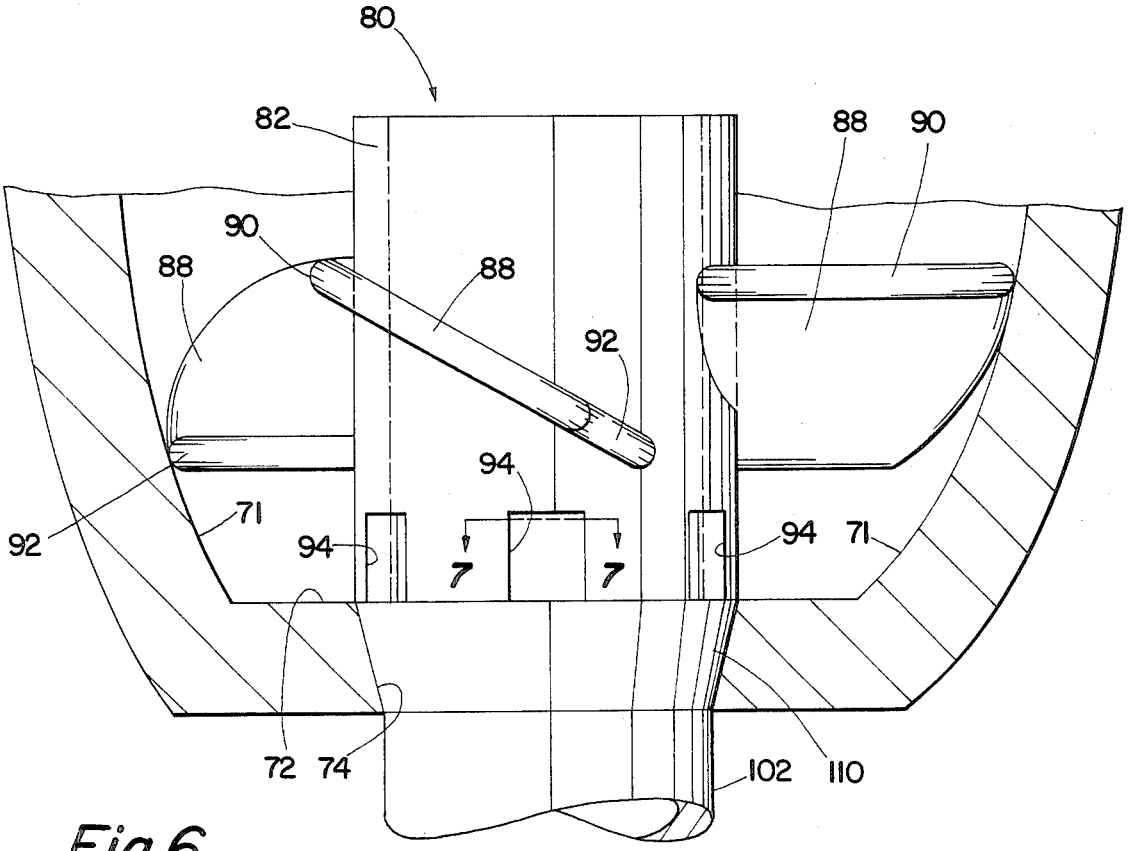
FIG. 6 is an enlarged side elevational view of the mixer of FIG. 3.
Figures 4, 5:
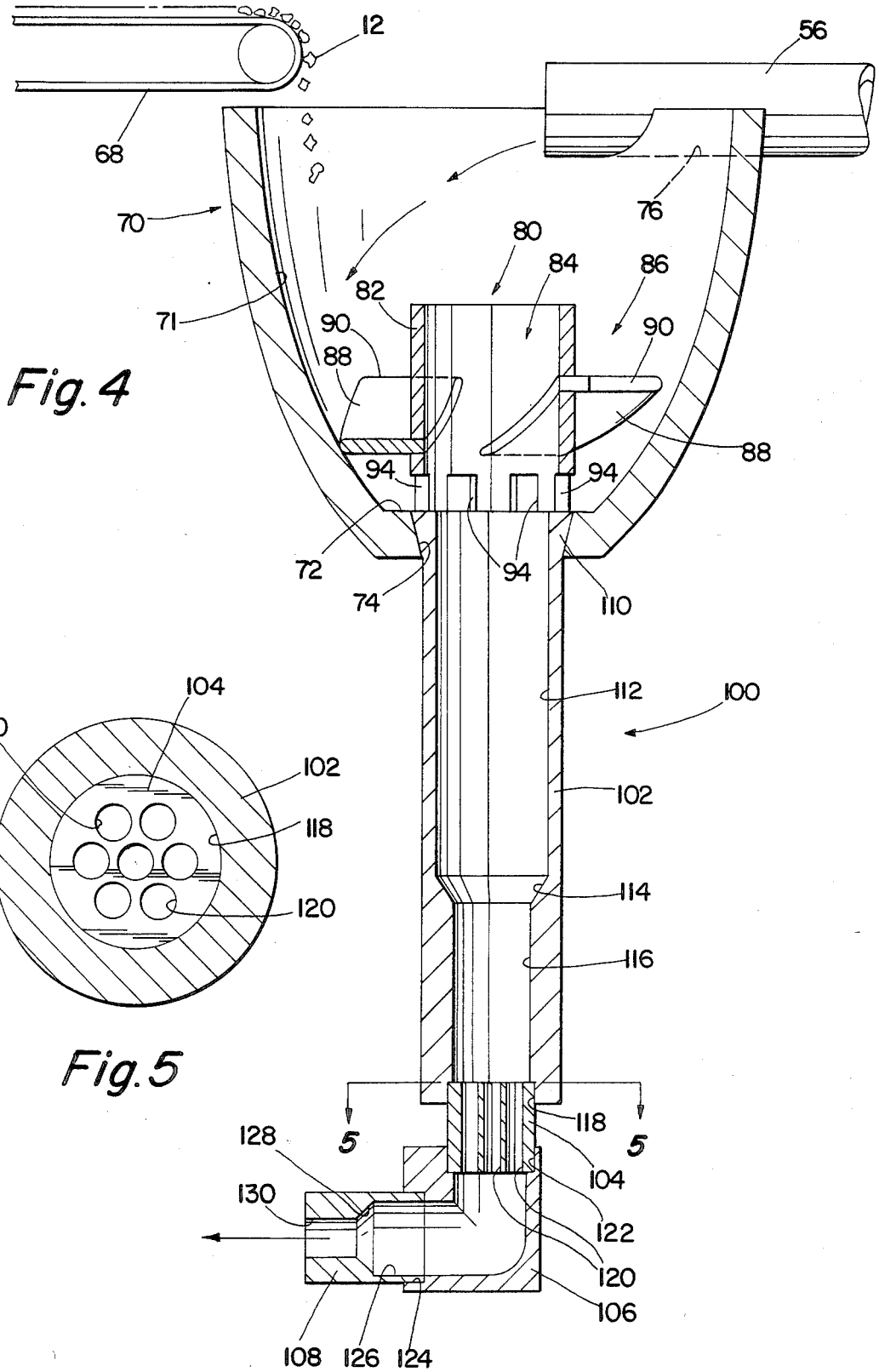
FIG. 4 is a cross-sectional view of the crucible, mixer, and discharge piping of FIG. 3 taken along a plane indicated by line 4—4 in FIG. 3.
FIG. 5 is an enlarged cross-sectional view of a portion of the discharge piping used with the crucible of FIG. 3 taken along a plane indicated by line 5—5 in FIG. 4.

As the flow of molten metal with the now-melted particles 12 swirls downwardly within the second chamber 86, eventually the molten metal encounters the openings 94. Referring particularly to FIG. 7, the molten metal impacts the edges of the openings 94. This impact, in conjunction with the impact with the blades 88 and the turbulence associated with the flow of molten metal within the second chamber 86, causes any agglomerated particles to be broken. As the molten metal passes through the openings 94, it is converted rapidly to vertical, downward flow into the inlet 112.

The honeycomb vortex breaker 104 controls, stabilizes, and stops the vortex action so that virtually all scrap metal particles are melted in the crucible 70. However, the vortex breaker 104 does permit additional mixing of scrap metal, agglomerations, and molten metal to occur downstream of the crucible 70. Such enhanced mixing action further enables the break-up of aggomerations to occur without proceeding totally unmelted through the system. In addition, the presence of the vortex breaker 104 permit a greater variability of the overall metal flow rate through the system without air ingestion than would otherwise occur. As indicated earlier, downstream of the vortex breaker 104, the discharge piping 100 can include a variety of elbows and straight lengths necessary to fit the available space. It is desirable, space permitting, to have a P-trap type of configuration to further enhance mixing and breaking up of agglomerations, thus further reducing the chances of air ingestion and subsequent oxidation, and yet additionally increasing the variability of the entire system to handle wider changes in metal flow rates and therefore higher melt rate capabilities.

By use of the mixer 80 according to the invention, particles 12 are submerged in the vortex quickly enough to prevent oxidation of the particles 12. Any solid particles 12 caught on the blades 88 are subjected to a rapidly moving liquid stream that erodes the particles 12 quickly. The trailing edges 92 and the openings 94 sufficiently obstruct the flow of molten metal that agglomerations are fractured, thus releasing the molten metal encased by them. Because the liquid level in the crucible always is above the vertical level of the openings 94, all or nearly all of the particles 12 will be melted by the time they reach the drain inlet 112. If, for some unanticipated reason, all of the openings 94 should become clogged, the molten metal will be able to spill over the upper edge of the sleeve 82 and flow directly through the inlet 112. Under these conditions, the height differential between the side wall 71 and the sleeve 82 causes the sleeve 82 to serve as a stand pipe.

In comparison with the system described in the '619 patent, the present invention provides an immediate and thorough mixing of the particles 12 with the molten metal in the vortex. No solid particles 12 are capable of riding the surface of the molten metal to the drain opening 74. The present invention avoids the ingestion of air, with the further result that the inlet 112 is subjected to an almost entirely liquid flow. Because the crucible 50 is operated with a liquid level well below the top of the side walls 71, the chances of a spillover are reduced, and the loss of heat through the side walls 71 is minimized. By using the method and apparatus according to the invention, recovery rates with reverbatory furnaces can approach 100 percent.

Although the invention has been described in its preferred form with a certain degree of particularity, it will be understood that the various components and their arrangement can be modified within the true spirit and scope of the invention as hereinafter claimed. In particular, it is to be understood that the disclosure of the particular furnace 14 has been only by way of example, and it is expected that the invention will be used with furnaces of other configurations. It is intended that the patent shall cover, by suitable expression in the appended claims, whatever degree of patentable novelty exists in the invention disclosed.

What is claimed is:

1. A crucible for melting metal particles in molten metal flowing in the crucible, comprising:

an annular side wall;

a bottom wall having an unobstructed opening therein; and mixing means for submerging metal particles within molten metal flowing in the crucible, the mixing means being disposed adjacent the bottom wall and being maintained stationary relative to the bottom wall and the side wall, the mixing means including a blade having a leading edge and a trailing edge, the leading edge being disposed at a higher vertical location than the trailing edge.

2. The crucible of claim 1, whrein the mixing means includes three blades, the blades being disposed radially equidistantly within the crucible.

3. The crucible of claim 1, wherein the blade is inclined at an angle of approximately 23 degrees from the horizontal.

4. The crucible of claim 1, wherein the mixing means includes a vertically oriented sleeve having a side wall, the sleeve being disposed within the crucible and resting on the bottom wall, the sleeve dividing the crucible into a first chamber within the sleeve and a second chamber surrounding the sleeve intermediate the side wall of the sleeve and the side wall of the crucible.

5. The crucible of claim 4, wherein the blade is disposed within the second chamber and is rigidly connected to the sleeve.

6. The crucible of claim 4, wherein the blade is disposed within the second chamber and is rigidly connected to the sleeve and to the side wall of the crucible.

7. The crucible of claim 4, wherein the opening in the bottom wall of the crucible is within the first chamber, and the sleeve includes an opening in the side wall of the sleeve adjacent the bottom wall of the crucible, the opening in the side wall of the sleeve providing fluid communication between the first and second chambers.

8. The crucible of claim 7, wherein the height of the sleeve is less than the height of the side wall of the crucible.

9. The crucible of claim 1, further including discharge piping connected to the opening in the bottom wall of the crucible for receiving molten metal from the crucible and conveying it away from the crucible.

10. The crucible of claim 9, further including a vortex breaker disposed within the discharge piping.

11. The crucible of claim 10, wherein the vortex breaker is in the form of a cylindrical body having a plurality of longitudinally extending passages.

12. A mixer for use in a crucible, comprising:

a vertically oriented sleeve having a side wall and first and second ends;

a blade secured to an outer surface of the side wall of the sleeve and inclined at an angle relative to a longitudinal axis of the sleeve, the blade having a leading edge and a trailing edge, the leading edge being located closer to the first end of the sleeve than the trailing edge; and an opening in the side wall of the sleeve adjacent the second end of the sleeve.

13. The mixer of claim 12, wherein three blades are provided, the blades being spaced radially 120 degrees from adjacent blades, and six openings are provided, the openings being spaced radially 60 degrees from adjacent openings.

* * * * *